US010238140B2

(12) United States Patent
Hansson et al.

(10) Patent No.: US 10,238,140 B2
(45) Date of Patent: Mar. 26, 2019

(54) METHOD AND APPARATUS FOR INTRODUCING ADDITIVES TO SMOKELESS TOBACCO PRODUCTS

(71) Applicants: British American Tobacco (Investments) Limited, London (GB); Fiedler & Lundgren AB, Malmo (SE)

(72) Inventors: Leif Hansson, Malmo (SE); Mazlam Orhan, Malmo (SE); Paul Leverick, Rotherham (GB); Michele Mola, London (GB)

(73) Assignee: Fiedler & Lundgren AB, Malmo (SE)

( * ) Notice: Subject to any disclaimer, the term of this patent is extended or adjusted under 35 U.S.C. 154(b) by 103 days.

(21) Appl. No.: 14/738,695

(22) Filed: Jun. 12, 2015

(65) Prior Publication Data

US 2015/0289558 A1 Oct. 15, 2015

Related U.S. Application Data

(62) Division of application No. 13/283,323, filed on Oct. 27, 2011, now Pat. No. 9,084,438.

(30) Foreign Application Priority Data

Oct. 29, 2010 (GB) ..... 1018291.3
Sep. 23, 2011 (GB) ..... 1116451.4

(51) Int. Cl.
*A24B 15/18* (2006.01)
*A24B 13/00* (2006.01)
(Continued)

(52) U.S. Cl.
CPC ..... *A24B 15/18* (2013.01); *A24B 13/00* (2013.01); *B65B 1/16* (2013.01); *B65B 1/36* (2013.01);
(Continued)

(58) Field of Classification Search
USPC ..... 131/112, 300, 111, 119, 306, 352, 347; 53/431, 473, 438, 439, 479, 523, 529,
(Continued)

(56) References Cited

U.S. PATENT DOCUMENTS 4,703,765 A 11/1987 Paules et al.
5,174,088 A 12/1992 Focke et al.
(Continued)

FOREIGN PATENT DOCUMENTS

EP 0186502 A2 7/1986
EP 2443943 A1 6/2010
(Continued)

OTHER PUBLICATIONS

Buy Swedish Snus Online—BuySnus.com, 2010, [online], retrieved from the Internet, [retrieved Mar. 11, 2017], <URL: https://www.buysnus.com/>.*
(Continued)

*Primary Examiner* — Dennis R Cordray
(74) *Attorney, Agent, or Firm* — McKee, Voorhees & Sease, PLC

(57) ABSTRACT

Methods of processing tobacco for the production of an oral tobacco product. According to one embodiment the method comprises providing a base blend of tobacco, delivering a pre-determined quantity of said base blend of tobacco to an individual consumer-portion container and introducing an additive to the tobacco directly in the container. Apparatuses for such methods are also provided.

17 Claims, 8 Drawing Sheets

(51) Int. Cl.

| | |
|---|---|
| ***B65B 1/16*** | (2006.01) |
| ***B65B 1/36*** | (2006.01) |
| ***B65B 5/10*** | (2006.01) |
| ***B65B 9/00*** | (2006.01) |
| ***B65B 29/00*** | (2006.01) |
| ***B65B 35/26*** | (2006.01) |
| ***B65B 61/06*** | (2006.01) |
| ***B65B 63/00*** | (2006.01) |

(52) U.S. Cl.
CPC ..... *B65B 5/101* (2013.01); *B65B 9/00* (2013.01); *B65B 29/00* (2013.01); *B65B 35/26* (2013.01); *B65B 61/06* (2013.01); *B65B 63/00* (2013.01); *B65B 2220/14* (2013.01); *B65B 2220/18* (2013.01)

(58) Field of Classification Search
USPC ..... 53/530, 558, 562, 206, 235; 35/111 R; 118/24, 25, 300
See application file for complete search history.

(56) References Cited

U.S. PATENT DOCUMENTS

| | | | | |
|---|---|---|---|---|
| 5,361,560 | A | 11/1994 | Sandolo | |
| 7,861,728 | B2 | 1/2011 | Holton et al. | |
| 8,978,661 | B2 * | 3/2015 | Atchley | A24B 13/00 131/111 |
| 9,237,768 | B2 * | 1/2016 | Carroll | A24B 13/00 |
| 9,675,102 | B2 * | 6/2017 | Hunt | A24B 15/281 |
| 2008/0202536 | A1 | 8/2008 | Torrence et al. | |
| 2008/0210249 | A1 | 9/2008 | Luzenberg | |
| 2009/0022917 | A1 | 1/2009 | Gedevanishvili et al. | |
| 2010/0199601 | A1 | 8/2010 | Boldrini et al. | |
| 2010/0218779 | A1 | 9/2010 | Zhuang et al. | |
| 2010/0300464 | A1 | 12/2010 | Gee et al. | |
| 2011/0239591 | A1 | 10/2011 | Gruss et al. | |
| 2012/0000165 | A1 | 1/2012 | Williams | |
| 2012/0037175 | A1 * | 2/2012 | Cantrell | A23G 3/40 131/353 |
| 2012/0125349 | A1 | 5/2012 | Williams | |

FOREIGN PATENT DOCUMENTS

| | | | |
|---|---|---|---|
| EP | 2446757 | A1 | 10/2011 |
| EP | 2532255 | A1 | 12/2012 |
| GB | 1171043 | A | 11/1969 |
| WO | WO 2003/028492 | A2 | 4/2003 |
| WO | WO 2006/127772 | A2 | 11/2006 |
| WO | WO 2007/037962 | A1 | 4/2007 |
| WO | 2008135468 | A1 | 11/2008 |
| WO | WO 2009/010878 | A2 | 1/2009 |
| WO | WO 2009/025604 | A1 | 2/2009 |
| WO | WO 2009/047627 | A1 | 4/2009 |
| WO | WO 2009/056611 | A2 | 5/2009 |
| WO | WO 2010/051826 | A1 | 5/2010 |
| WO | 2011102788 | A1 | 8/2011 |
| WO | 2011117730 | A2 | 9/2011 |

OTHER PUBLICATIONS

Definition of "balance", "balanced", "balancing" and "balances", The Free Dictionary by Farlex, No Date, [onlone]. retrieved from the Internet, retrieved Oct. 22, 2017], <URL: https://www.thefreedictionary.com/balancing>.*

European Search Report, dated Feb. 13, 2012 for EP Application No. 11186405.4, filed Oct. 24, 2011.

* cited by examiner

METHOD AND APPARATUS FOR INTRODUCING ADDITIVES TO SMOKELESS TOBACCO PRODUCTS

CROSS-REFERENCE TO RELATED APPLICATIONS

This application is a divisional under 35 U.S.C. § 121 of U.S. patent application Ser. No. 13/283,323 entitled, "Method and Apparatus for Introducing Additives to Smokeless Tobacco Products," filed Oct. 27, 2011, which claims priority under 35 U.S.C. § 119 to British Application Serial No. GB 1116451.4, filed Sep. 23, 2011, and to British Application Serial No. GB 1018291.3, filed Oct. 29, 2010. The entire contents of the aforementioned applications are herein expressly incorporated by reference.

FIELD

The present disclosure relates to methods and apparatuses for the production of smokeless tobacco products, and particularly, for introducing additives to snus tobacco products.

BACKGROUND

Various tobacco products are available which are intended for oral administration and do not require combustion. 'Smokeless oral tobacco products' are tobacco products which are not intended for combustion but which are instead designed to be placed in the oral cavity of a user for a limited period of time, during which there is contact between the user's saliva and the product.

Snus is a moist smokeless oral tobacco product which is provided in loose form or in individually wrapped pouches and the tobacco may include additives, such as flavoring agents, preservatives and/or balancing agents. In production of snus products, loose tobacco, often in the form of a metered plug of tobacco, is fed under air pressure through a tube into the pouch or a container. Alternatively, the metered portion of loose tobacco may be pushed out of a metering device directly into a container. The present disclosure provides improvements over the current state of the art as disclosed herein.

BRIEF DESCRIPTION OF THE DRAWINGS

Various non-limiting aspects of embodiments of the present disclosure will now be described, by way of example only, with reference to FIGS. 3-8 of the accompanying drawings, in which.

DETAILED DESCRIPTION

Figure 1:
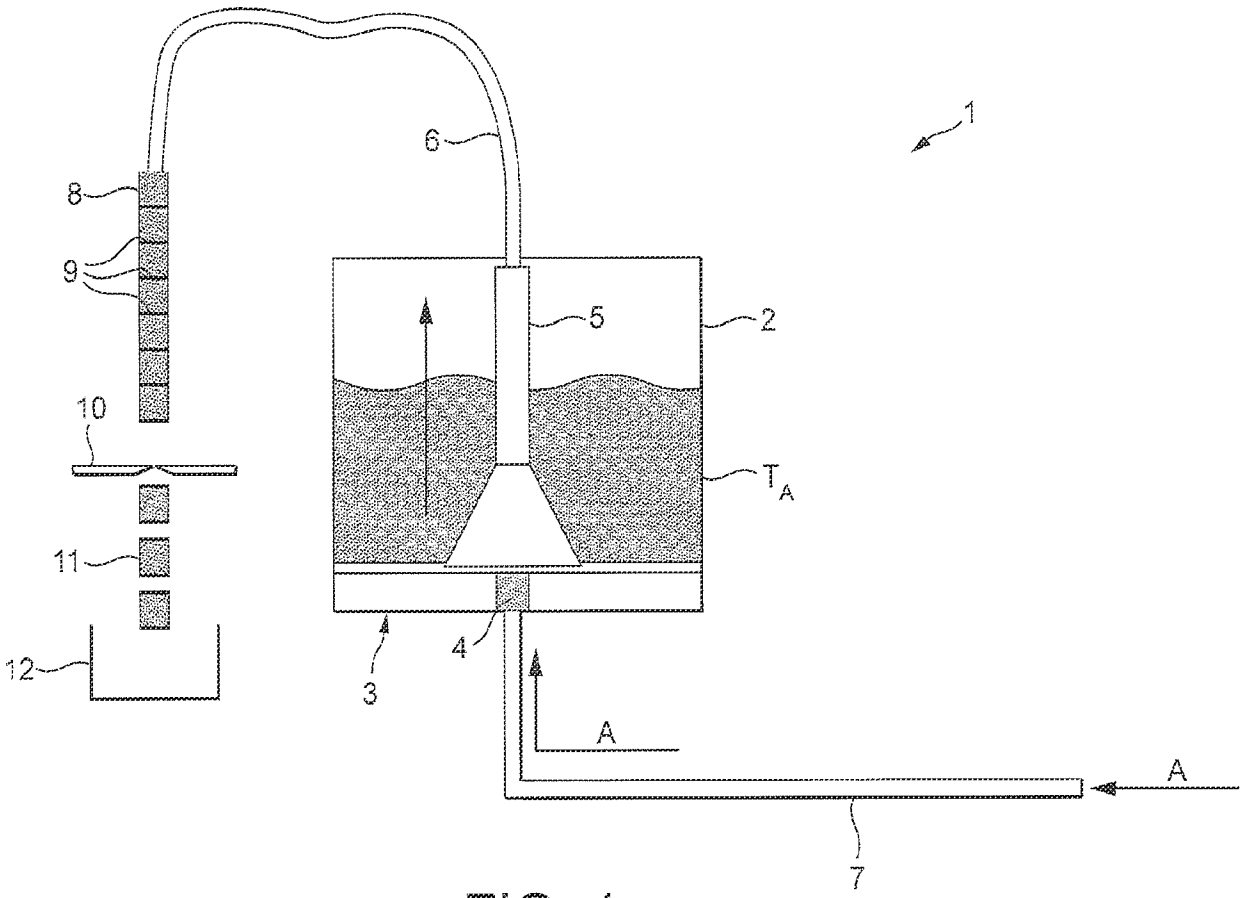
FIG. 1 (PRIOR ART)
FIG. 1 shows a schematic view of a conventional snus processing apparatus.

The present disclosure provides methods of processing tobacco for the production of oral tobacco products, including providing a base blend of tobacco in a vessel, delivering the base blend of tobacco from the vessel, introducing an additive to the tobacco delivered from the vessel and delivering the tobacco to an individual consumer-portion container.

A problem with conventional SIMS manufacturing processes arises due to the production of snus products with a variety of different additives. Conventionally, the additives are added to loose snus tobacco which is then stored in containers until it is to be packaged or filled into individual snus pouches in a later separate manufacturing process. There may be a large number of containers of different loose snus tobacco for the different varieties of snus mixtures and flavors, which requires a large amount of storage space and which also requires complicated and therefore costly monitoring and tracking procedures for the different containers. Furthermore, there results a certain amount of wasted snus tobacco due to the large volume of different varieties of the moist suns tobacco needing to be stored and consequently the increased occurrence of some deteriorating during prolonged storage and becoming unusable. In addition, extensive cleaning of the snus processing machinery is needed when the processing is switched from one variety of snus tobacco to another, in order to prevent contamination of the latter variety with the former.

The present disclosure provides methods of producing smokeless tobacco products, such as snus and snus pouches, which substantially alleviates or overcomes the problems mentioned above.

In one embodiment, the additive is introduced to the tobacco in the container through at least one spray nozzle and the additive is introduced to the tobacco in the container in intermittent pulses during filling of the container with the tobacco product. In some implementations, intermittent pulses of additive are coordinated in time with when the tobacco product is being delivered into the container.

A controller may be coupled to a first means, such as a tobacco product dispenser or other dispenser for providing tobacco product into the container and to a second means, such as an additive dispenser or other dispenser for introducing additive into the container, and the controller may control the second means to coordinate the intermittent pulses of additive with when the tobacco product is delivered into the container.

In another embodiment, the additive is introduced into the container as a constant flow thereof.

The method may further comprise transporting metered amounts of the base blend tobacco though a duct of a tobacco processing machine with a stream of compressed air.

In one embodiment, the method may further comprise forming and/or directing the base blend of tobacco into individual pouches of tobacco to form said tobacco product, delivering the individual tobacco pouches into the container and introducing the additive to the tobacco pouches directly in the container.

In another embodiment, the base blend tobacco may be delivered directly into the container as loose tobacco comprising the tobacco product and the additive is introduced to the loose tobacco product in the container.

In another embodiment, the method can further include delivering base blend tobacco into pouch material (such as a film or tube of a form fill and seal machine), introducing an additive to the pouch material, forming the tobacco containing pouch material into individual pouches of tobacco to form the tobacco product and delivering the tobacco product into the container.

In some embodiments, the loose base blend tobacco may be formed into metered portions of tobacco product using a metering device and the metered portions may be provided directly into the container.

In some embodiments, the method may further comprise closing the container with a lid and sealing the closed container for subsequent retail to a consumer after the additive has been introduced to the loose/pouch tobacco.

In some implementations, the base blend tobacco delivered to the tobacco is unflavored and/or comprises no additives. An additive may be introduced into the container during filling of the container with the loose/pouch tobacco product(s). Alternatively, the additive may be introduced into the container after the container is full of loose/pouch tobacco product(s).

The method may further comprise subsequently manufacturing a different oral tobacco product by delivering a tobacco product from the tobacco processing machine into a second individual retail-portion container and introducing a second additive directly onto the tobacco product into the second container that is different from the first additive. Accordingly, in one aspect, the method may further comprise switching a source of additive in an additive-introducing means, such as a dispenser, from the first additive to the second additive. Alternatively, the method may comprise introducing said first additive from a first additive introducing means and introducing the second additive from a distinct second additive introducing means.

In another aspect, the disclosure provides an exemplary apparatus and/or system for processing tobacco for production of an oral tobacco product. In some embodiments, the apparatus includes a vessel to contain loose base blend tobacco to be processed, a guide duct connected to the vessel into which tobacco from the vessel can be provided, a tobacco delivery means or dispenser configured to provide metered portions of tobacco product to be delivered into an individual consumer-portion container, and an additive system such as a dispenser that is adapted and/or configured to introduce a liquid additive to the tobacco after it has exited the guide duct.

In one embodiment, the additive system comprises a spray nozzle coupled to a liquid reservoir configured to introduce liquid additive mist into the container. The apparatus may further comprise a controller coupled to the tobacco delivery means and to the liquid additive system which is configured to control the additive system to spray additive into the container in intermittent pulses in coordination with when the tobacco product is delivered to the container. Alternatively, the flavour additive system may be configured to spray additive into the container as a constant flow thereof.

In a another embodiment, the additive system comprises a plurality of separate additive devices, such as dispensers, each configured to introduce a different additive to a tobacco product directly into the container after it has exited the guide duct. In an alternative embodiment, the additive system comprises a plurality of separate nozzles, each nozzle coupled to a separate source of additive and configured to introduce a different additive to a tobacco product directly into the container after it has exited the guide duct.

In accordance with a further aspect, the system or device can include a source of compressed air connected to the guide duct via a supply pipe or conduit to provide a compressed airstream to the guide duct to transport tobacco therethrough and the tobacco delivery means or dispenser can be configured to deliver tobacco from the vessel into the guide duct to be transported therethrough.

If desired, in some implementations the tobacco delivery means or dispenser may comprise a plug former or other plug forming means configured to form a plug of a metered amount of tobacco and deliver the metered plug into the guide duct.

In another aspect, the apparatus may further comprise a pouch-former or other pouch-forming means, such as a heat sealer including one or more platens, to introduce the metered plugs of tobacco into pouch material, form individual sealed tobacco pouches and deliver the tobacco pouches into the container.

In another aspect, the tobacco pouches can be treated with the liquid additive after being deposited into the container. Alternatively, the pouch material can be treated with the liquid additive prior to forming the individual sealed tobacco pouches.

For purposes of illustration, a conventional apparatus 1 for producing snus pouches is shown schematically in FIG. 1 and comprises a tobacco hopper 2 to hold loose snus tobacco TA which already includes all required additive agents, such as flavorants, preservatives and/or balancing agents, a plug-forming means 3 at the bottom of the hopper 2 to form the loose snus tobacco TA into individual metered plugs 4 of snus, and a guide duct 5 for the formed plugs of snus 4 to travel through to a snus dosing pipe 6 connected to the other end of the guide duct 5. In use, the plugs of snus 4 travel through the guide duct 5, through the dosing pipe 6 and into a sleeve of pouch material 8 which is then sealed closed between each plug with a weld seam 9 and cut at each scam with a cutter 10 to form individual snus pouch portions 11. These individual snus pouches 11 are then packed into containers 12.

A pipe 7 is connected to the base of the hopper 2 at the bottom end of the guide duct 5 and is connected to a source of compressed air (not shown) to provide a compressed air flow (shown by arrows 'A') though the pipe 7, into the guide duct 5 to propel each plug of snus 4 though the guide duct 5, through the dosing pipe 6 and into the pouch material sleeve 8.

Figure 2:
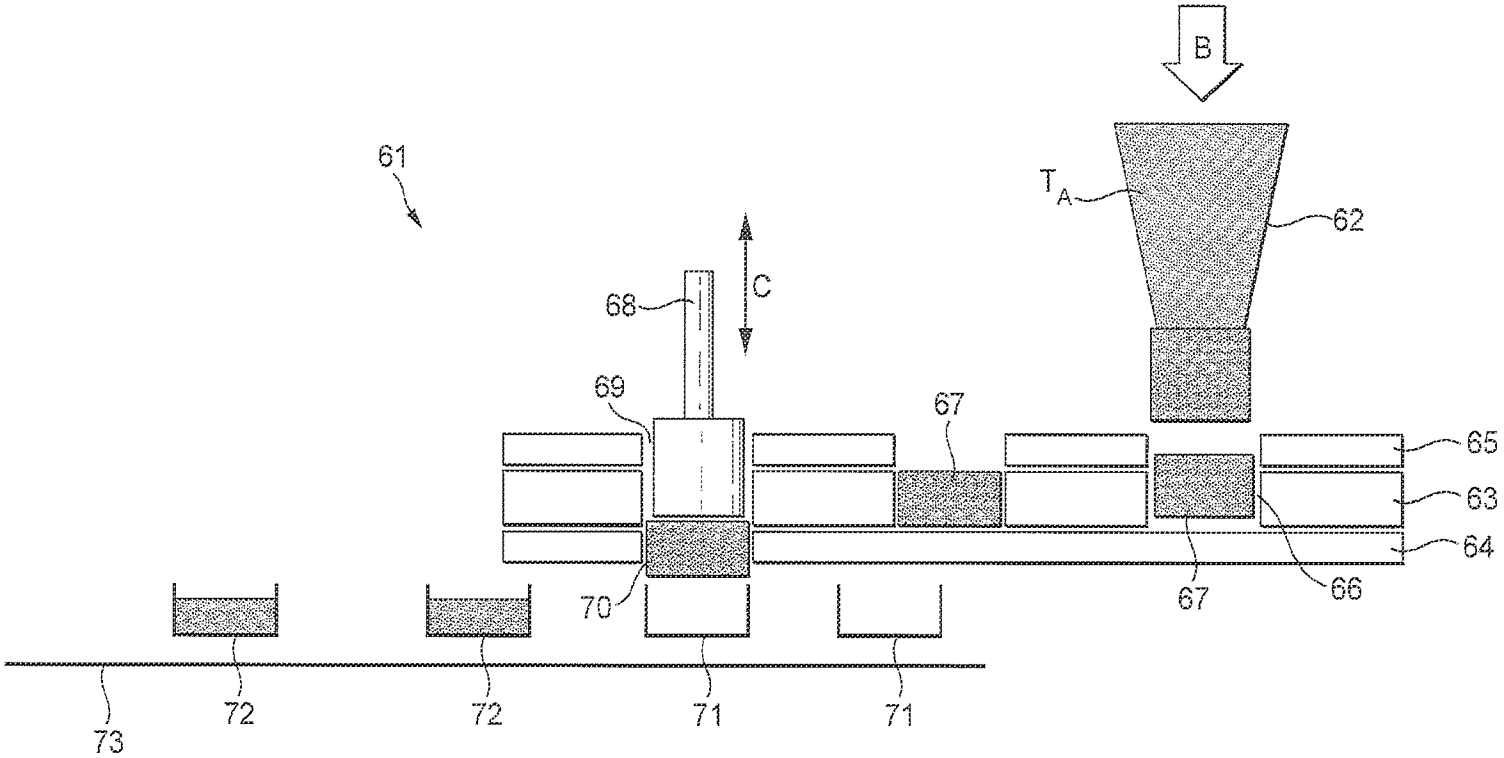
FIG. 2 (PRIOR ART)
FIG. 2 shows a schematic view of another conventional snus processing apparatus.

Another conventional type of apparatus 61 for producing tobacco products, this time for producing metered portions of loose snus tobacco, is shown schematically in FIG. 2 and comprises a tobacco feed duct 62 to receive loose snus tobacco TA (shown by arrow B) from a hopper (not shown), the loose tobacco TA already including all of the required additive agents, such as flavorants, preservatives and/or balancing agents. A metering device configured to form metered portions of loose tobacco is disposed adjacent the bottom of the feed duct 62 and comprises a rotating metering plate 63, a base plate 64 and a scraper plate 65. The rotating metering plate 63 includes a plurality of tobacco metering apertures 66 which receive the loose snus tobacco TA from the feed duct 62, after which rotation of the rotating metering plate 63 relative to the scraper plate 65 levels off the loose tobacco in the metering apertures 66 to form consistent metered portions of tobacco 67.

A plunger 68 is provided to reciprocate up and down (see arrow C) to push each metered portion of tobacco 67 our of the metering device as the metering aperture 66 in the rotating metering plate 63 aligns with an aperture in the scraper plate 65 and a dispensing aperture 70 in the base plate 64. The dispensed metered portions of tobacco 67 are received in empty containers 71 beneath the base plate 64 and are conveyed away on a conveyor 73 as full containers 72 for sealing and packing.

Both of the above conventional systems suffer the problems discussed above, that with production of tobacco products comprising snus pouches or loose tobacco portions having a variety of different blends, a large range of different blends of snus tobacco needs to be stored, tracked and monitored, and there is the risk that some may deteriorate due to prolonged storage between production runs. Also, there is the requirement to clean the production machinery in between each production run of a different snus tobacco variety to avoid contamination of additives between different blends. Conventionally, the pre-additive-treated tobacco would be loaded into the hopper 2 and formed into the snus pouches 11 in the process described above with reference to FIG. 1, or formed into metered portions 67 of loose tobacco in the process described above with reference to FIG. 2, and the whole system would be cleaned when a different tobacco blend was to be fed into the hopper 2 to produce a different variety of snus product.

Figure 3:
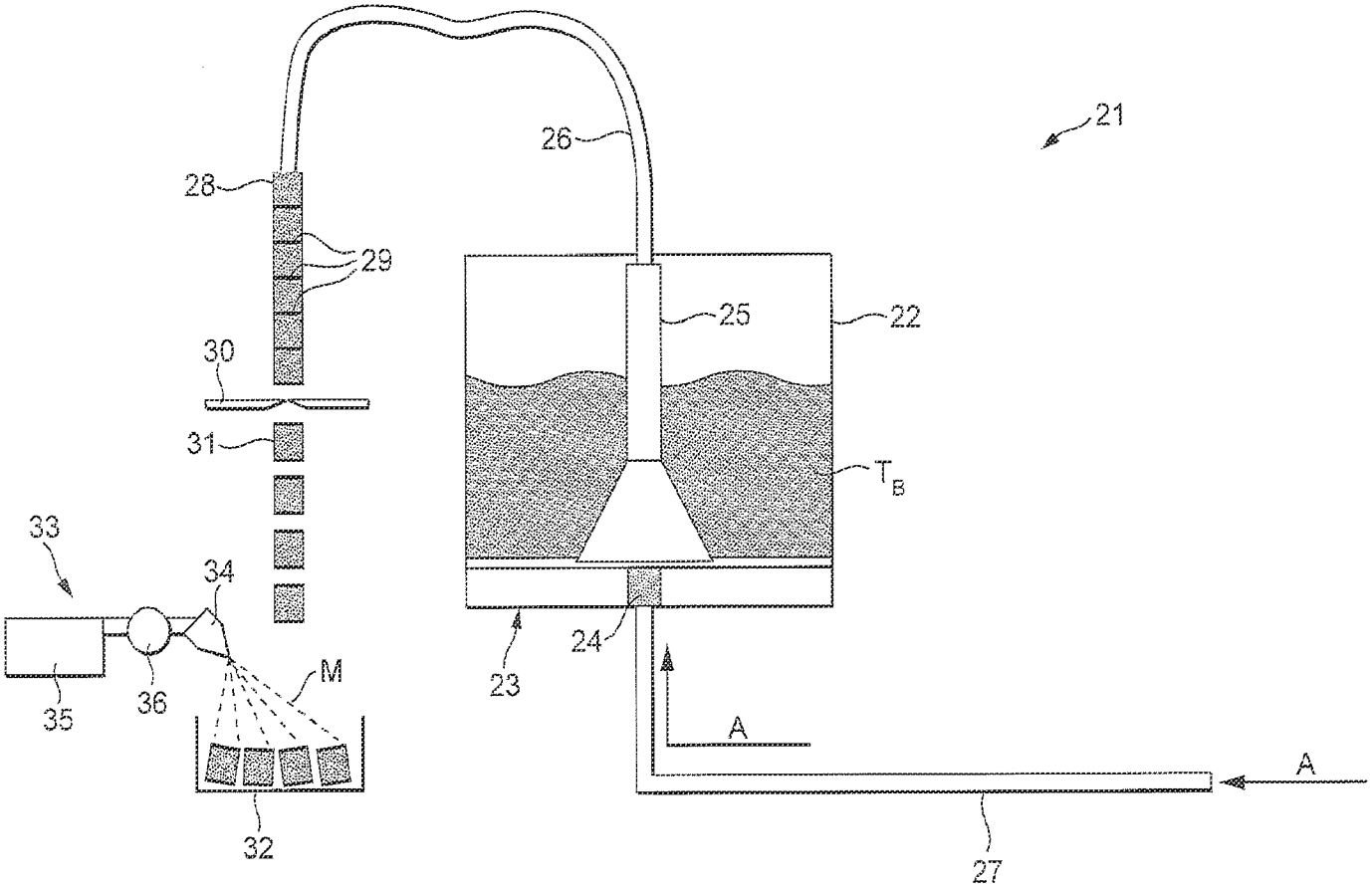
FIG. 3 shows a schematic view of a snus processing apparatus according to one embodiment of the present disclosure.

In order to overcome the above-described problems, for purposes of illustration, and not limitation, as embodied herein and illustrated in FIG. 3, an exemplary apparatus 21 for producing snus pouches according to a first embodiment of the present disclosure is shown schematically in FIG. 3 and comprises a tobacco hopper 22 to hold loose snus tobacco TB, a plug former or other plug-forming means 23 at the bottom of the hopper 22 to form the loose snus tobacco TB into individual metered plugs 24 of snus, and a guide duct 25 for the formed plugs of snus 24 to travel through to a snus dosing pipe 26 connected to the other end of the guide duct 25 and on to a sleeve of pouch material 28 which is then sealed closed between each plug with a weld seam 29 and cut at each seam with a cutter 3(1 to form individual snus pouch portions 31. These individual snus pouches 31 are then packed into containers 32. A pipe 27 is connected to the base of the hopper 22 and is connected to a source of compressed air (not shown) to provide a compressed air flow (shown by arrows 'A') though the pipe 27, into the guide duct 25 to propel each plug of suns 24 though the guide duct 25, through the dosing pipe 26 and into the pouch material sleeve 28.

The illustrated exemplary apparatus 21 differs from the conventional apparatus shown in FIG. 1 in at least that the loose tobacco TB in the hopper 22 is a plain base blend of loose tobacco and does not include many of the additive agents that the final snus product is intended to include. Furthermore, the apparatus 21 includes an additive system or additive dispenser 33 located proximate the end of the process line where the individual snus pouches 31 are packed into the container 32. As illustrated, the additive system 33 comprises a spray nozzle 34 coupled to a source of liquid additive 35 via a pump 36, the nozzle 34 being configured to spray a mist M of liquid additive directly into the container 32 as the individual snus pouches 31 are delivered thereto. The container 32 includes the individual product portion containers or cans which are to be sealed and eventually sold to consumers.

In some implementations, the snus pouches 31 may be formed in the manner described above, although the formed pouches 31 may only contain base blend snus tobacco and not the product-specific additive agents that the final product may be intended to include. However, as the snus pouches are delivered into the container 32, the additive system 33 sprays the specific mixture of additive agents directly into the container 32 where it is absorbed into the pouches 31 of base blend snus tobacco so that the resulting snus pouches exhibit the exact or particular properties as required, similar to or the same as if the tobacco has been pre-treated with the required additive agents prior to being filled into the hopper 22 of the processing apparatus.

The additive system or dispenser 33 may be configured to spray a pulse of liquid additive mist M into the container 32 at regular intervals during filling of the container 32 with snus pouches 31. A controller (not shown) may be connected to the pouch-forming apparatus and may control the additive system 33 to co-ordinate spraying pulses of additive M into the container 32 when each individual container 32 is being filled, and to provide the correct dose and even distribution of additive per pouch or per container full of pouches, and/or to stop spraying the additive between container change-over when one container is full and the next empty container takes its place. In some implementations the additive system 33 of may provide a continuous spray of additive M into the container. Again, this could be controlled by a controller (nor shown) to control the additive system 33 to co-ordinate continuous spraying of additive M into the container 32 when each individual container 32 is being filled, and to provide the correct dose of additive per pouch or per container full of pouches, and/or stop spraying the additive between container change-over when one container is full and the next empty container takes its place. Alternatively, the additive system 33 may provide a continuous spray of additive M into the container for the duration of time the processing system is in operation, and container 32 change-over may be quick to minimize additive agent wastage. A system comprising a controller can make most efficient use of the additive agent, avoiding any wastage, whereas the latter system without a controller may be less complex and therefore less expensive in terms of apparatus costs.

It will be appreciated that the exemplary illustrative methods, apparatuses and systems described above alleviates or overcomes the above-described problems with the conventional system shown in FIG. 1 because, rather than providing the hopper with a large number of different pre-additive-treated loose tobacco blends to create the corresponding number of varieties of snus pouch products, the embodiments shown in FIG. 3 and onward permit a much smaller number of base tobacco blends (potentially as little as a single base blend) to be used without requiring the desired additive(s) to be fed into the hopper. in some embodiments, the additives are only applied to the base tobacco blend TB at the final container-filling stage, and so none of the snus processing and pouch-forming machinery is contaminated with the individual mixtures of additives of each specific snus variety. Such embodiments may eliminate the need to halt production runs between manufacturing different snus varieties to clean the apparatus to avoid additive contamination between products, as the same base tobacco blend TB can be used for many, or even all, varieties of snus products to be produced. This may increase production efficiency and/or may have cost savings by providing reduced production down-time and lowering the machinery maintenance required. In some such implementations, only the source 35 of additive may need to be changed when a product production run is changed. Alternatively, in some implementations, a plurality of additive systems 33, or spray nozzles 34, may be provided, one for each variety of additive mixture corresponding to each different snus product variety.

Figure 4:
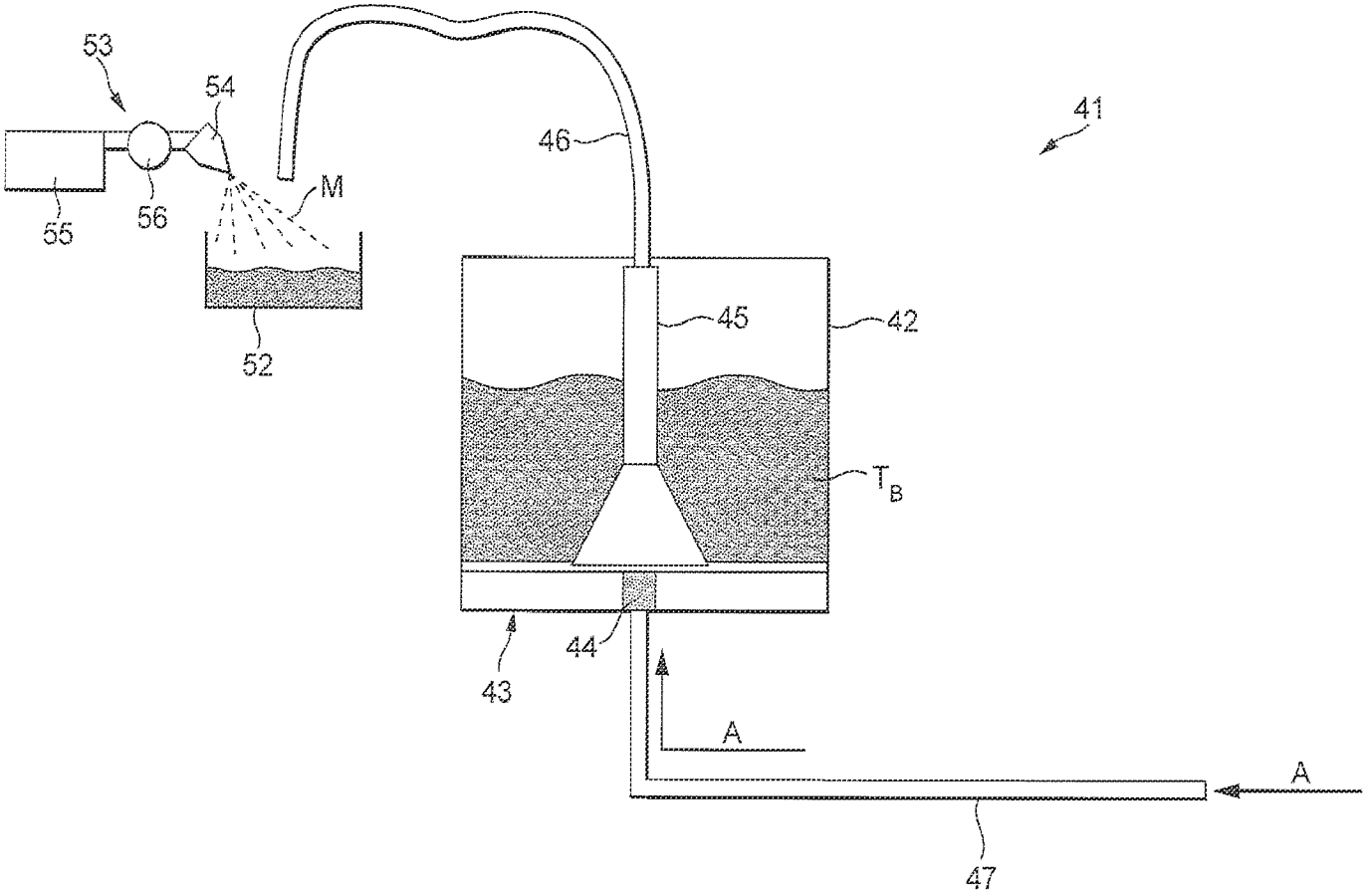
FIG. 4 shows a schematic view of an alternative snus processing apparatus according to a second embodiment of the present disclosure.

FIG. 4 shows an alternative illustrative embodiment 41 of an apparatus comprising a tobacco hopper 42 to hold loose snus tobacco TB, a tobacco meter or other tobacco metering means 43 at the bottom of the hopper 42 to provided metered amounts 44 of tobacco from the loose snus tobacco TB in the hopper 42, and a guide duet 45 and snus dosing pipe 46 as with the embodiment shown in FIG. 3. However, this embodiment does not produce individual snus pouches, but rather containers of loose snus tobacco, so none of the pouch-producing features are present, and the loose snus tobacco TB is provided directly from the snus dosing pipe 46 into a container 52. A pipe 47 is connected to the base of the hopper 42 and is connected to a source of compressed air (not shown) to provide a compressed air flow (shown by arrows 'A') though the pipe 47, into the guide duct 45 to propel the snus 44 though the guide duct 45, through the dosing pipe 46 and into the container 52.

As with the embodiment shown in FIG. 3, the apparatus 41 of the embodiment illustrated in FIG. 4 may include plain base blend of loose tobacco TB in the hopper which does not include many (or in some implementations any) of the additive agents that the final snus product is intended to or will ultimately include. Furthermore, the apparatus may include an additive system or dispenser 53 located proximate the end of the dosing pipe 46 where the loose base blend snus tobacco TB is delivered into the container 52. In some implementations, the additive system 53 comprises a spray nozzle 54 coupled to a source of liquid additive 55 via a pump 56, the nozzle 54 being configured to spray a mist M of liquid additive into the container 52 as the loose snus tobacco TB is delivered thereto.

In use, loose base blend suns tobacco TB without specific additive agents is delivered into the container 52 and the additive system 53 sprays the specific mixture of additive agents directly into the container 52 where it is absorbed by the base blend snus tobacco TB so that it exhibits the exact properties as required, the same as if the tobacco has been pre-treated with the required additive agents prior to being filled into the hopper 42 of the processing apparatus.

In some implementations, the additive system 53 may be configured to spray a pulse of liquid additive mist M into the container 52 at regular intervals during filling of the container 52 with snus tobacco TB and a controller (not shown) may control the additive system 53 to co-ordinate spraying pulses of additive M into the container 52 when each individual container 52 is being filled and to provide the correct dose and even distribution of additive per container full of tobacco, and/or to stop spraying the additive between container change-over when one container is full and the next empty container takes its place. In some embodiments the additive system 53 may provide a continuous spray of additive M into the container 52. Again, in some implementations this could be controlled or managed by a controller (not shown) to control the additive system 53 to co-ordinate continuous spraying of additive M into the container 52 when each individual container 52 is being filled, and to provide the correct dose of additive per container full of loose tobacco, and/or stop spraying the additive between container change-over when one container is full and the next empty container takes its place. Alternatively, the additive system 53 may provide a continuous spray of additive M into the container for the duration of rime the processing system is in operation, and container 52 change-over may be quick to avoid additive agent wastage. The various benefits of such embodiments are as described above with reference to the embodiment illustrated in FIG. 3.

Figure 5:
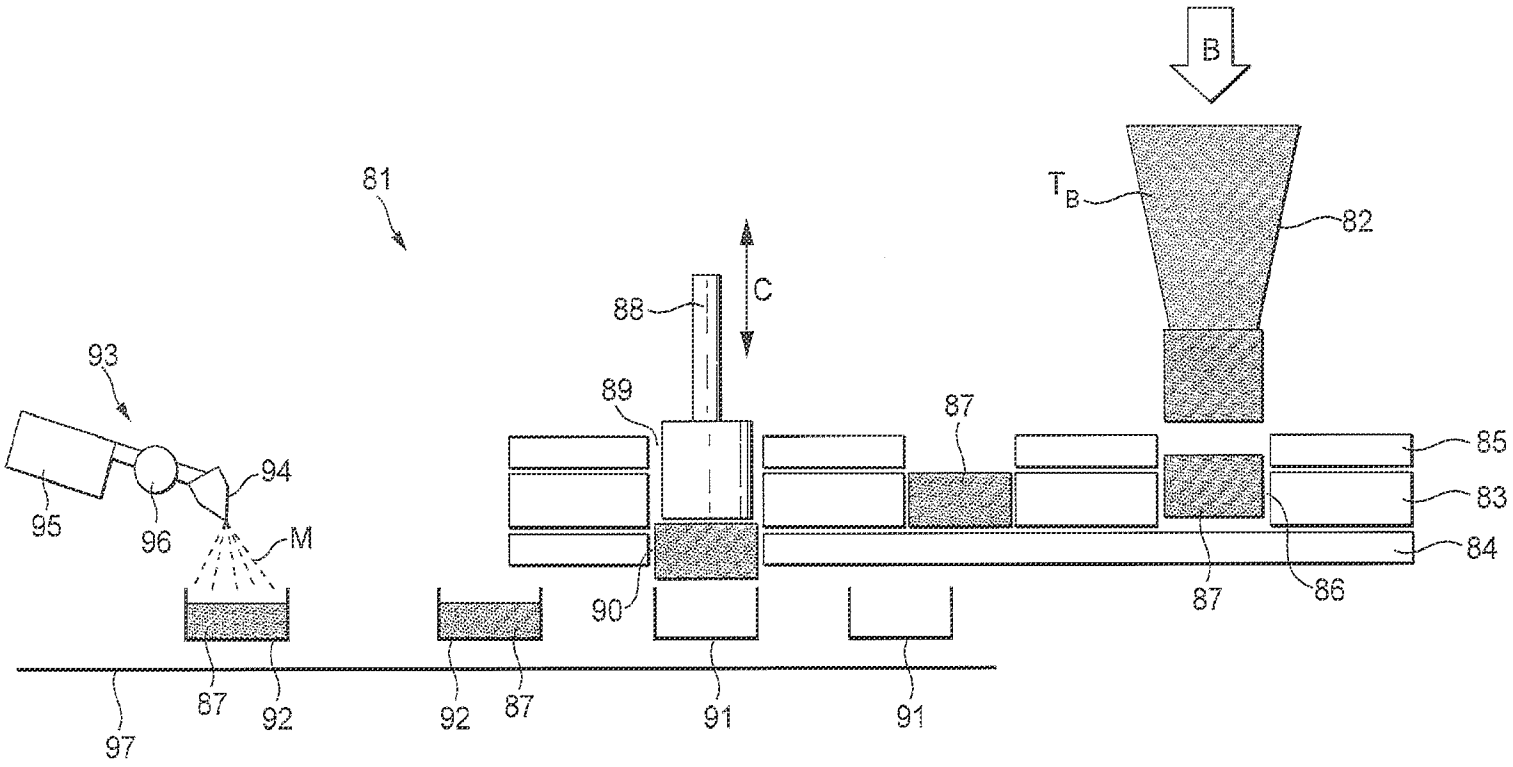
FIG. 5 shows a schematic view of yet another alternative snus processing apparatus according to a third embodiment of the present disclosure.

In order to overcome the problems described above with the conventional loose tobacco container processing apparatus 61 shown in FIG. 2, an apparatus 81 of a further alternative illustrative embodiment of the invention is shown in FIG. 5. Such an apparatus may comprise a tobacco feed duct 82 to receive loose snus tobacco (shown by arrow 13) from a hopper (not shown) and convey it to a meter or other metering device to form metered portions of loose tobacco. In some embodiments, the meter or other metering device may comprise a rotating metering plate 83 including a plurality of tobacco metering apertures 86 which receive the loose snus tobacco TB, a base plate 84 and a scraper plate 85. In some such embodiments, rotation of the rotating metering plate 83 relative to the scraper plate 85 levels off the loose tobacco TB in the metering apertures 86 to form consistent metered portions of tobacco 87.

A plunger 88 is provided reciprocate up and down (see arrow C) to push each metered portion of tobacco 87 out of the metering device as the metering aperture 86 in the rotating metering plate 83 aligns with an aperture in the scraping plate 85 and a dispensing aperture 90 in the base plate 84. The dispensed metered portions of tobacco 87 are received in empty containers 91 beneath the base plate 84 and are conveyed away on a conveyor 97 as full containers 92 for sealing and packing.

According to some embodiments, the apparatus 81 differs from a conventional apparatus as shown in FIG. 2 in at least that the loose tobacco TB supplied to the feed duct 82 is a plain base blend of loose tobacco and does not include many of the additive agents that the final snus product is intended to include. According to some embodiments, the apparatus 81 includes an additive system or dispenser 93 located adjacent the metering device where the full containers 92 are delivered. The additive system 93 may comprise a spray nozzle 94 coupled to a source of liquid additive 95 via a pump 96, the nozzle 94 being configured to spray a mist M of liquid additive directly into the container 92 once the metered portion of tobacco 87 is delivered thereto. The containers 92 comprise the individual product portion containers or cans which are to be sealed and eventually sold to consumers.

In some implementations, metered portions of loose tobacco 87 may be formed in the manner similar to that described above with reference to FIG. 2, although the tobacco is only a base blend snus tobacco TB and does not include the product-specific additive agents that the final product is intended to include. In some embodiments, once the metered portions of tobacco 87 are delivered into the containers 91, the additive system 93 sprays the specific mixture of additive agents directly into the container 92 where it is absorbed into the loose base blend snus tobacco TB therein so that the resulting additive-treated tobacco exhibits the exact properties as required, similar to or the same as if the tobacco has been pre-treated with the required additive agents prior to being filled into the hopper of the processing apparatus.

In some embodiments, a controller (not shown) may be connected to the apparatus 81 and may control the additive system 93 to co-ordinate spraying pulses of additive M into the container 92 and/or to provide the correct dose and even distribution of additive per container, and/or to stop spraying the additive between containers 92 as they pass the spray nozzle 94. In some embodiments, the additive system 93 may provide a continuous spray of additive NI into the containers 92. As discussed above, some implementations may utilize a controller (not shown) to control the additive system 93 and co-ordinate continuous spraying of additive M into the container 92 to provide the correct dose of additive per container full and/or stop spraying the additive between containers 92 as they pass the spray nozzle 94. Alternatively, in some implementations, the additive system 93 may provide a continuous spray of additive M into the container 92 for the duration of time the processing system is in operation, and container 92 change-over may be quick to minimize additive agent wastage. An embodiment in which a system comprises a controller may provide efficient use of the additive agent, avoiding most or any wastage, whereas an embodiment without a controller may be less complex and therefore less expensive in terms of apparatus costs.

It will be appreciated that the methods and apparatuses described above may alleviate or overcome the described problems with conventional systems such as shown in FIG. 2 because, instead of providing the hopper with a large number of different pre-additive-treated loose tobacco blends to create the corresponding number of varieties of loose snus tobacco products, the embodiments described above may utilize a much smaller number of base tobacco blends (potentially as few as one single base blend) without many of the desired additives being fed into the hopper. In some implementations, the additives are only applied to the base tobacco blend TB at the final container-filling stage, and so none of the snus tobacco processing and metering machinery is contaminated with the individual mixtures of additives of each specific snus variety. Therefore, in some implementations, there is no need to halt production runs between manufacturing different snits varieties to clean the apparatus to avoid additive contamination between products, as the same base tobacco blend TB can be used for many, or even all, varieties of snus products to be produced. Such implementations may greatly increase production efficiency and provide cost savings by reducing production down-time and lowering the amount or frequency of machinery maintenance required. In some such implementations, only the source 95 of additive may need to be changed when a product production run is changed. Alternatively, a plurality of additive systems 93, or spray nozzles 94, may be provided, one for each variety of additive mixture corresponding to each different loose snus tobacco product variety.

Figure 6:
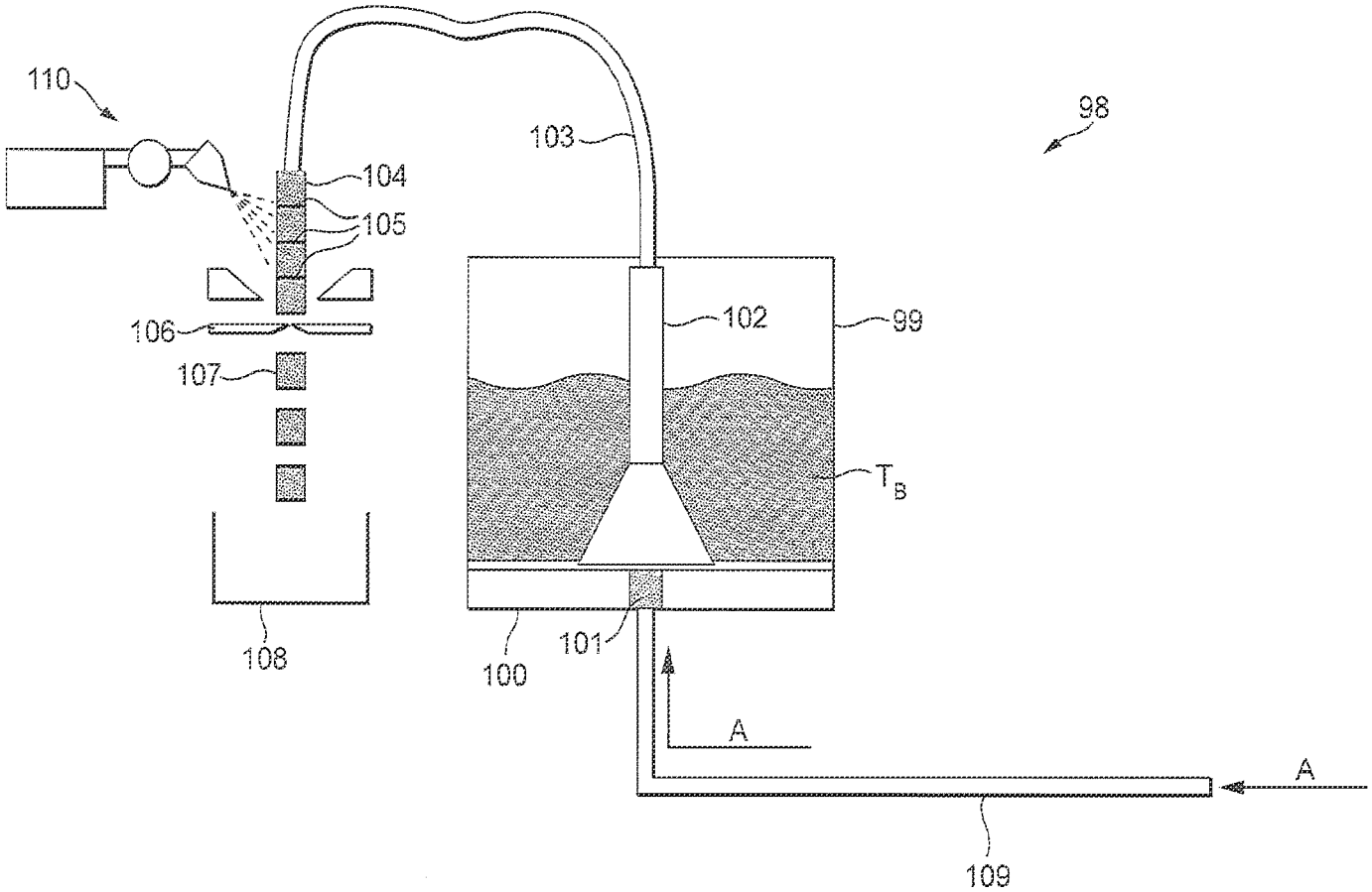
FIG. 6 shows a schematic view of a snus processing apparatus according to a fourth embodiment of the present disclosure.

FIG. 6 is a schematic representation of an apparatus 98 according to a fourth illustrative embodiment of the present invention. In some implementations, the apparatus 98 may be similar to the apparatus 21 shown in FIG. 3. The illustrated apparatus 98 comprises tobacco hopper 99 to hold loose snus tobacco TB, a plug former 100 at the bottom of the hopper 99 to form the loose snus tobacco TB into individual metered plugs 101 of snus, and a guide duct 102 for the formed plugs of snus 101 to travel through to a snus dosing pipe 103 connected to the other end of the guide duct 102 and on to a sleeve of pouch material 104 which is then sealed closed between each plug with a weld scam 105 and cut at each scam with a cutter 106 to form individual snus pouch portions 107. These individual snus pouches 107 are then packed into containers 108. A pipe 109 is connected to the base of the hopper 99 and is connected to a source of compressed air (not shown) to provide a compressed gas/air flow (shown by arrows 'A') though the pipe 109, into the guide duct 102 to propel each plug of snus 101 though the guide duct 102, through the closing pipe 103 and into the pouch material sleeve 104.

The illustrated apparatus 98 differs from the apparatus 21 of the first embodiment in that an additive system 110 is situated above the cutter 106, replacing the additive system 33 shown in FIG. 3. The additive system 110 sprays an additive over the tube of pouch material 104 before the pouch material 104 is cut by the cutter 106 along weld seams 105, forming individual snus pouches 107. The individual snus pouches may then be packed into containers 108.

Figure 7:
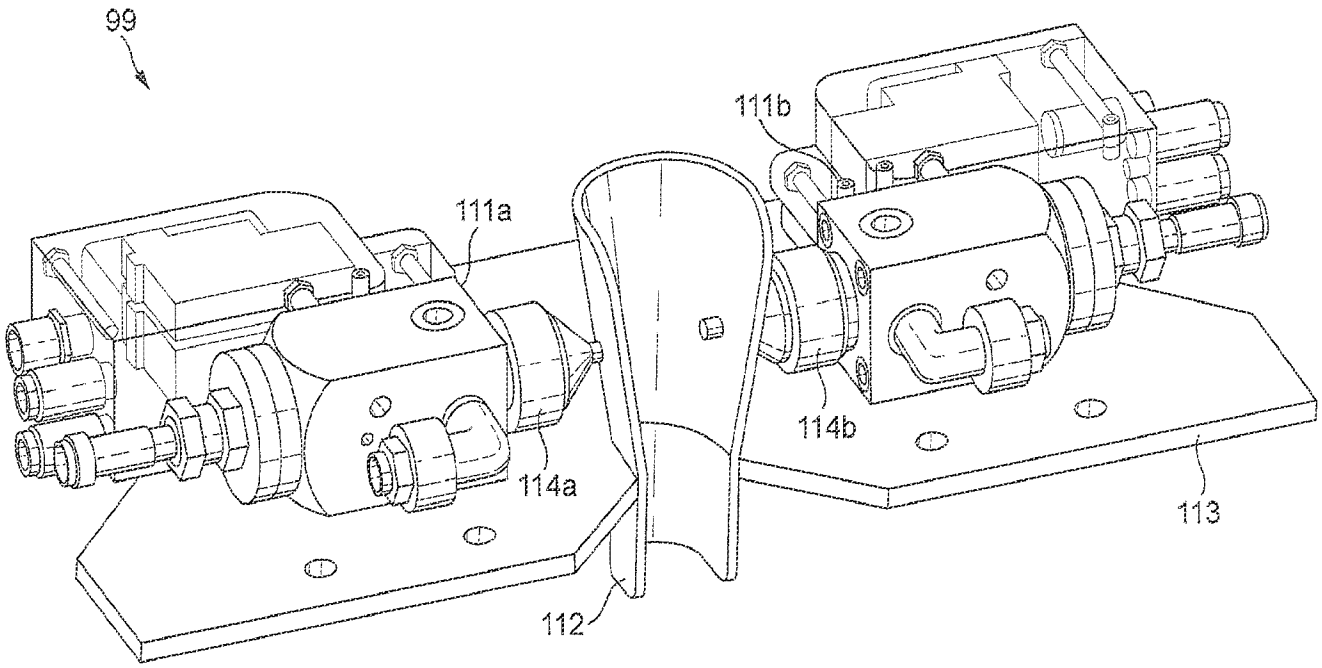
FIG. 7 shows an elevated view of an additive system according to an implementation of the fourth embodiment of the present disclosure.

FIG. 7 shows the additive system 110 of the fourth embodiment in more detail. The additive system 110 comprises first and second applicator heads 111*a*, 111*b*, guide tube 112 and support plate 113. The guide tube 112 serves to guide the pouch material 104 towards the cutter 106. The support plate 113 is situated to support the first and second applicator heads 111 above the cutter 106 and at the lower end of the tube of pouch material 104, as shown in FIG. 6. The first and second applicator heads 111*a*, 111*b* comprise first and second nozzle spray heads 114*a*, 114*b* respectively. The first and second applicator heads 111 are located on opposing sides of the support plate 113 so that the first and second nozzle spray heads 114 point inwardly into the guide tube 112. Using first and second nozzle spray heads 114*a*, 114*b*, rather than a single nozzle spray head may ensure a larger surface area of the pouch material 104 is coated with additive agent. An adjustment assembly (not shown) may adjust the position of the nozzle spray heads 114*a*, 114*b* so that the additive agent may be applied over the desired portion of the pouch material 104. insulating blocks (not shown) may be provided between the cutter 106 and the additive system 110 to prevent heat from the cutter 106 affecting the performance of the additive system 110.

Figure 8:
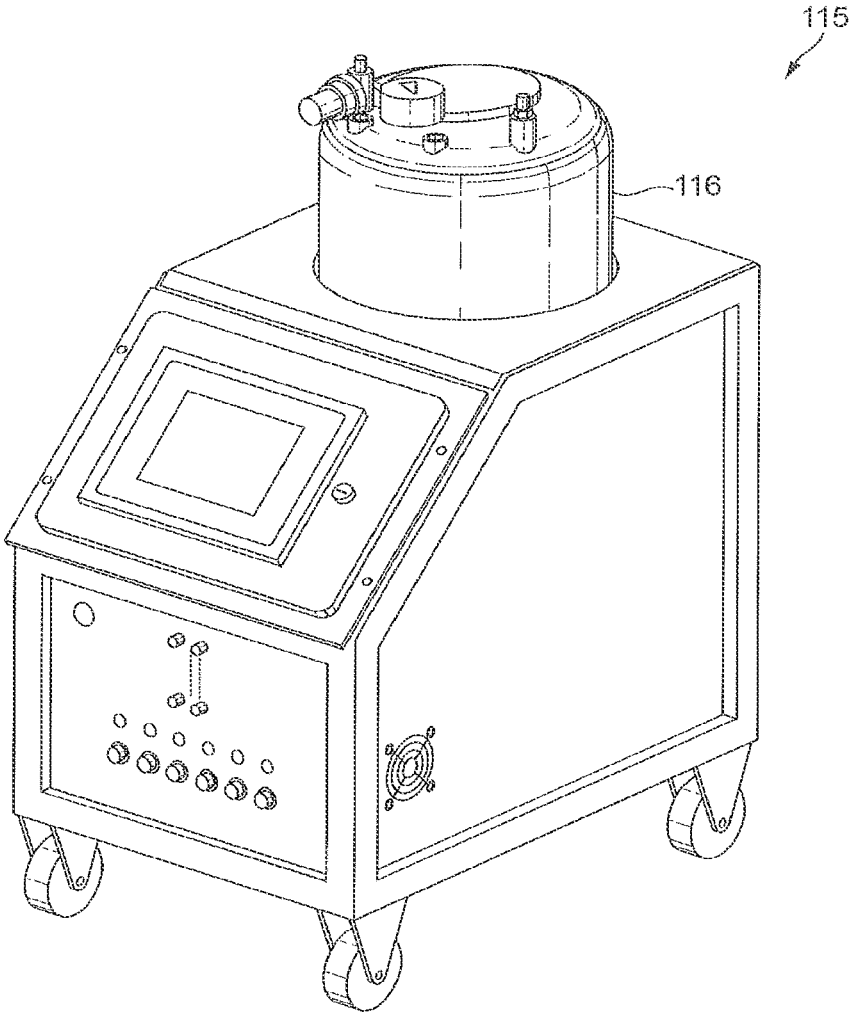
FIG. 8 shows a perspective view of a base station according to an implementation of the fourth embodiment of the present disclosure.

FIG. 8 shows a base module 115 to which the additive system 110 may be connected, according to some embodiments. The base module 115 comprises a pressurized storage tank 116 to store the additive agent. The pressure inside the storage tank 116 may be controlled, for example, using air fittings such as valves. The base module 115 may also comprise a processor and a user interface such as a touch screen to enable a user to control the application of the additive agent to the pouch material 104.

According to some embodiments, a valve in the first and second applicator heads 111*a*, 111*b* is opened upon instruction from the processor located in the base module 115. Air pressure in the storage tank 116 drives the additive agent through the nozzle spray heads 114*a*, 114*b* and onto the surface of the pouch material 104. The processor performs checks to ensure that the additive agent has been released. The volume of additive agent released may be controlled by the pressure within the storage tank 116 and the length of time during which the valve is released. For example, the additive agent may be released intermittently or continuously, depending on the embodiment. Such parameters may be controlled by inputting values into the user interface. The desired volume of additive agent to be released may depend on factors such as the viscosity of the additive agent. The weight of the storage tank 116 may be monitored to assess the volume of additive agent present in the storage tank 116.

It will be appreciated that the methods and apparatuses described above may alleviate or overcome the above-described problems with the conventional systems because, according to some implementations, rather than providing the hopper with a large number of different pre-additive-treated loose tobacco blends to create the corresponding number of varieties of snus pouch products, a much smaller number of base tobacco blends (potentially as few as one single base blend) without many of the desired additives is fed into the hopper 99. In some embodiments the additives are only applied to the base tobacco blend TB at the final container-filling stage, and so none of the snus processing and pouch-forming machinery is contaminated with the individual mixtures of additives of each specific snus variety. Therefore, there is no need to halt production runs between manufacturing different snus varieties to clean the apparatus to avoid additive contamination between products, as the same base tobacco blend TB can be used for many, or even all, varieties of snus products to be produced. This greatly increases production efficiency and so has cost saving consequences as there is much less production downtime and machinery maintenance required. In such implementations, only the storage tank 116 containing the additive agent may need to be changed when a product production run is changed. Alternatively, a plurality of additive systems 99 may be provided, one for each variety of additive mixture corresponding to each different snus product variety.

In order to address various issues and advance the art, the entirety of this disclosure (including the Cover Page, Title, Headings, Field, Background, Summary, Brief Description of the Drawings, Detailed Description, Claims. Abstract, Figures, and/or otherwise) shows by way of illustration various embodiments in which the claimed inventions) may be practiced and provide for superior techniques for treating and packaging tobacco products. The advantages and features of the disclosure are of a representative sample of embodiments only, and are not exhaustive and/or exclusive. They are presented only to assist in understanding and teach the claimed principles. it should be understood that they are not representative of all claimed inventions. As such, certain aspects of the disclosure have not been discussed herein. That alternate embodiments may not have been presented for a specific portion of the invention or that further undescribed alternate embodiments may be available for a portion is not to be considered a disclaimer of those alternate embodiments. It will be appreciated that many of those undescribed embodiments incorporate the same principles of the invention and others are equivalent. Thus, it is to be understood that other embodiments may be utilized and modifications may be made without departing from the scope and/or spirit of the disclosure. As such, all examples, implementations, and/or embodiments are deemed to be non-limiting throughout this disclosure. Also, no inference should be drawn regarding those embodiments discussed herein relative to those nor discussed herein other than it is as such for purposes of reducing space and repetition. Various embodiments may suitably comprise, consist of, or consist essentially of, various combinations of the disclosed elements, components, features, parts, steps, means, etc. Some of the disclosed features, elements, implementation, etc., may be mutually contradictory, in that they cannot be simultaneously present in a single embodiment. Similarly, some features are applicable to one aspect of the disclosure, and inapplicable to others. In addition, the disclosure includes other inventions not presently claimed. Applicant reserves all rights in those presently unclaimed inventions including the right to claim such inventions, file additional applications, continuations, continuations in part, divisions, and/or the like thereof. As such, it should be understood that advantages, embodiments, examples, functional, features, structural, topological, and/or other aspects of the disclosure are not to be considered limitations on the disclosure as defined by the claims or limitations on equivalents to the claims.

What is claimed:

1. A method of processing tobacco for the production of an oral tobacco product in a process line, comprising:

providing a plain base blend of tobacco in a vessel, the plain base blend not including any or many additive agents that the oral tobacco product is intended to include;

delivering the plain base blend of tobacco from the vessel to an individual consumer-portion container;

delivering the plain base blend of tobacco in the consumer-portion container to an additive system located proximate the end of the process line;

introducing, proximate the end of the process line and using the additive system, liquid additive agents including flavourants, preservatives, and/or balancing agents to the plain base blend of tobacco in the container;

wherein the step of delivering the plain base blend of tobacco from the vessel to the individual consumer-portion container comprises:

directing the base blend of tobacco into individual pouches of tobacco to form a tobacco product and delivering the individual tobacco pouches into the container; or directing the plain base blend of tobacco directly into the container as loose tobacco comprising tobacco product; and wherein the liquid additive is introduced to the tobacco pouches in the container or the loose tobacco product in the container by introducing the additive directly into the container.

2. The method according to claim 1, wherein the additive is introduced to the tobacco through at least one spray nozzle.

3. The method according to claim 2, wherein the additive is introduced to the tobacco in intermittent pulses during filling of the container with tobacco product.

4. The method according to claim 3, wherein the intermittent pulses of additive are coordinated in time with when the tobacco product is being delivered into the container.

5. The method according to claim 4, wherein a controller is coupled to a tobacco dispenser for providing tobacco product into the container and to a additive dispenser for introducing additive into the container, and wherein the controller controls the additive dispenser to coordinate the intermittent pulses of additive with when the tobacco product is delivered into the container.

6. The method according to claim 1, wherein the additive is introduced as a constant flow thereof.

7. The method according to claim 1, further comprising transporting metered amounts of the base blend tobacco through a duct of a tobacco processing machine with a stream of compressed air.

8. The method according to claim 1, wherein the loose base blend tobacco is formed into metered portions of tobacco product using a metering device and the metered portions are provided directly into the container.

9. The method according to claim 1, wherein the additive is introduced into the container during filling of the container with the pouch tobacco products.

10. The method according to claim 1, wherein the additive is introduced into the container after the container is full of pouch tobacco products.

11. The method according to claim 1, further comprising:

closing the container with a lid and sealing the closed container after the additive has been introduced to the tobacco.

12. The method according to claim 1, wherein the base blend tobacco delivered into the individual container is at least one of unflavored and comprises no additives.

13. The method according to claim 1, further comprising:

subsequently manufacturing a subsequent, different oral tobacco product by delivering the base blend of tobacco from a tobacco processing machine into a second individual consumer-portion container and introducing a second, different additive directly onto the second individual consumer-portion container.

14. The method according to claim 13, further comprising:

switching a source of additive in an additive-introducing dispenser from the first additive to the second additive.

15. The method according to claim 13, further comprising:

introducing said first additive from a first additive introducing dispenser and introducing said second, different additive from a separate second additive introducing dispenser.

16. The method according to claim 1, wherein the additive is introduced into the container during filling of the container with the loose tobacco product.

17. The method according to claim 1, wherein the additive is introduced into the container after the container is full of loose tobacco product.

* * * * *